United States Patent [19]

Kattner

[11] Patent Number: 4,963,897

[45] Date of Patent: Oct. 16, 1990

[54] PLANAR INK-JET PRINT HEAD IN A DUAL IN-LINE PACKAGE

[75] Inventor: Erich Kattner, Neubiberg, Fed. Rep. of Germany

[73] Assignee: Siemens Aktiengesellschaft, Berlin and Munich, Fed. Rep. of Germany

[21] Appl. No.: 430,443

[22] PCT Filed: Mar. 15, 1988

[86] PCT No.: PCT/DE88/00153

§ 371 Date: Oct. 10, 1989

§ 102(e) Date: Oct. 10, 1989

[87] PCT Pub. No.: WO88/07935

PCT Pub. Date: Oct. 20, 1988

[30] Foreign Application Priority Data

Apr. 15, 1987 [DE] Fed. Rep. of Germany ..... 3712891

[51] Int. Cl.[5] ..... B41H 2/045

[52] U.S. Cl. ..... 346/140 R

[58] Field of Search ..... 346/140

[56] References Cited

U.S. PATENT DOCUMENTS

| | | | |
|---|---|---|---|
| 4,381,515 | 4/1983 | Bain | 346/140 |
| 4,611,219 | 9/1986 | Sugitani et al. | 346/140 |
| 4,635,080 | 1/1987 | Watanabe | 346/140 |
| 4,695,854 | 9/1987 | Cruz-Uribe | 346/140 |

FOREIGN PATENT DOCUMENTS

| | | |
|---|---|---|
| 3612846 | 10/1986 | Fed. Rep. of Germany . |
| 61474 | 5/1980 | Japan . |
| 161667 | 12/1980 | Japan . |
| 56-84977 | 7/1981 | Japan . |
| 60-204345 | 10/1985 | Japan . |
| 2130528 | 6/1984 | United Kingdom . |

*Primary Examiner*—Joseph W. Hartary

*Attorney, Agent, or Firm*—Jeffrey P. Morris

[57] ABSTRACT

A sandwich ink-jet print head constructed in planar technology is welded into a dual in-line plug-in package which has on its top side a receiving opening for the sandwich ink-jet head and on its underside a contacting and balancing opening which can be sealed so as to be tight with respect to ink, as well as an ink inlet orifice for supplying the printing fluid. After insertion of the sandwich ink-jet head into the dual in-line package, the sandwich ink-jet head is electrically balanced via the contacting and balancing opening, to be precise by means of a resistor array arranged on the sandwich ink-jet head. As a result of the arrangement in a dual in-line package, the ink-jet print head can be mounted so as to be exchangeable in a mounting on the printer carriage. The ink-jet print head is connected to the ink supply system of the printer via a resilient adaptor.

7 Claims, 2 Drawing Sheets

PLANAR INK-JET PRINT HEAD IN A DUAL IN-LINE PACKAGE

Figure 1:
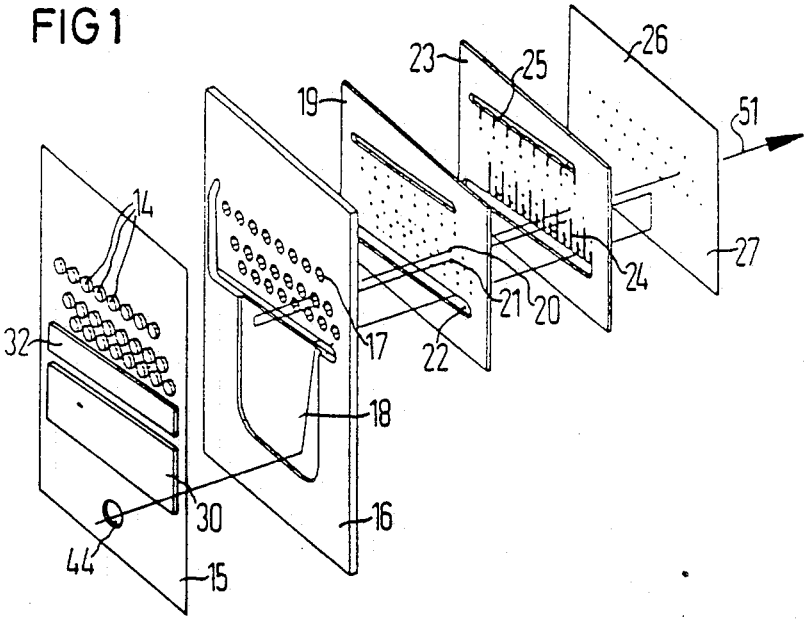

The invention relates to an ink-jet print head for an ink-jet printing machine, having a sandwich ink-jet head composed of individual superjacently arranged plates which accommodate ink ducts, drive elements, pressure chambers and the like, and which are rigidly connected to one another, and having an ink inlet orifice for the supply of the printing fluid.

Ink-jet printing devices with drive elements driven piezoelectrically or via heating elements are generally know and have been used successfully. For instance FR-A-2 518 901 discloses a multilayer-type ink-jet print head which is of sandwich construction and consists of a plurality of superjacently arranged plates which are rigidly connected to one another. The ink-jet print head furthermore has an ink-jet inlet orifice for the supply of the printing fluid.

It is also known from Patent Abstracts of Japan, Volume 10, No.55 (M-458)(2112), March 5, 1986 and JP-A-60 204 345 to arrange an ink-jet print head in a plug-in package with connecting leads. In this arrangement the ink-jet print head is plugged onto an ink reservoir and connected to the ink reservoir via a connecting piece.

In order to balance the ink-jet print head, it is customary to assign an electric balancing element to each drive element, it being possible for said balancing element to be designed as a resistor which can be balanced using a laser. In the ink-jet print head known from US-A-4 381 515, there are arranged on a chip balancing elements for a network preventing cross-talk of the drive elements which is balanced before being fitted into the actual ink-jet print head.

The object of the invention is to design an ink-jet print head of the type mentioned at the beginning in such a way that on the one hand it can be produced in a simple manner and on the other hand it is possible to mount it easily in the ink-jet printing device.

This object is achieved by an ink-jet print head of the type mentioned at the beginning in accordance with the features of the first patent claim.

Advantageous embodiments of the invention are disclosed in the subclaims.

The ink-jet print head consists of a sandwich ink-jet head composed of individual superjacently arranged plates which accommodate ink ducts, drive elements with piezoelectric elements or electrothermal transducers, pressure chambers and the like, and which are rigidly connected to one another, the sandwich ink-jet head being arranged in a plug-in package with connecting leads. An opening in the plug-in package provides access to the sandwich ink-jet head in order to be able to electrically balance and contact the sandwich ink-jet head.

After balancing, said contacting and balancing opening is sealed so as to be tight with respect to ink. In addition, the ink-jet print head has an ink inlet opening for the supply of printing fluid.

An ink-jet print head constructed in this manner can be produced automatically, and moreover permits the print head to be arranged in a corresponding socket or solder mounting via the connecting leads of the plug-in package, which permits simple exchange of the print head during servicing.

In an advantageous embodiment of the invention, an electric balancing element is assigned in each drive element of the sandwich ink-jet head, the balancing element consisting of resistors which can be balanced by a laser and which are arranged in the sandwich ink-jet head integrated on a plate. In addition, the sandwich ink-jet head may have elements for ink heating.

Since the required balancing resistors are arranged on the sandwich ink-jet head and can be balanced automatically using a laser, no further balancing of the ink-jet printing head is necessary by means of a separate balancing module.

The ink-jet print head itself is constructed here so that it has the necessary stability to accommodate any cleaning and sealing stations which may be arranged in front of the print head.

Strips arranged laterally on the plug-in package and projecting beyond the plug-in package, prevent the connecting leads being dirtied by ink, and in addition a drip gutter designed on the top side of the plug-in package ensures reliable removal of excess ink. A resilient adaptor connection, which comes to lie against the ink supply opening when the ink-jet print head is mounted, provides a simple coupling of the ink-jet print head with the ink supply system.

The ink-jet print head is produced in a simple manner in that first of all the sandwich ink-jet head is produced in planar technology then the sandwich ink-jet head is mounted in the plug-in package itself using welding or spraying methods, and then the electrical contacts between the sandwich ink-jet head and the connecting leads are made using bonding machines. After mechanical production and filling of the ink-jet print head, an electrical balancing of the series resistors assigned to each individual drive element is carried out using a laser during a trial printing operation. After closure of the contacting and balancing opening, for example by ultrasound welding or adhesion, the ink-jet print head is operational and can be mounted in a corresponding connector strip or another receptacle of the printer carriage.

Exemplary embodiments of the invention are illustrated in the drawings and are described more fully below.

Figure 2:
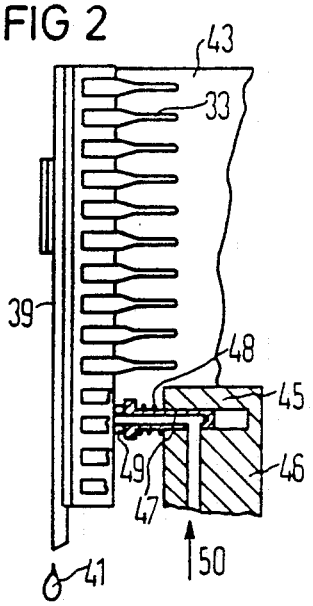
Figure 3:
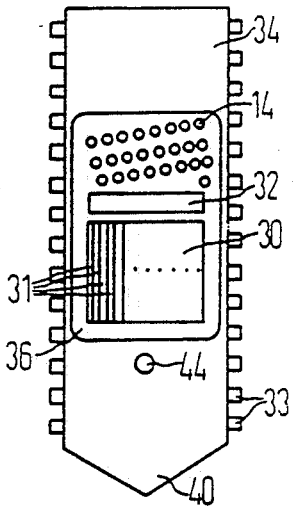
Figure 4:
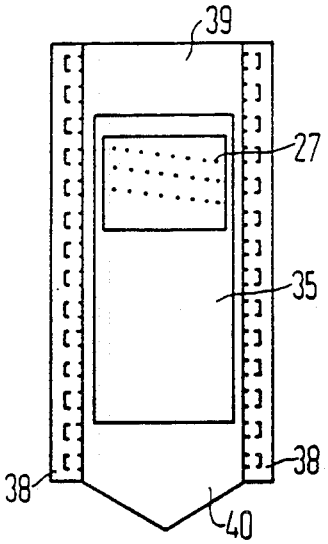
Figure 5:
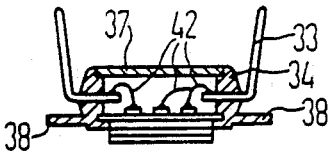

FIG. 1 shows a diagrammatic representation of the construction of the sandwich head, FIG. 2 shows a diagrammatic representation of the ink-jet print head in the working position with ink adaptor connected, FIG. 3 shows a diagrammatic representation of the ink-jet print head with open casing from below, FIG. 4 shows a diagrammatic representation of the ink-jet print head from above, and FIG. 5 shows a diagrammatic sectional representation of the ink-jet print head.

In an ink-jet printing device which is not shown in detail here, there is arranged on a printer carriage an ink-jet print head which is moved during printing line by line along a recording medium. The ink-jet print head contains a sandwich ink-jet head constructed in planar technology which, in the exemplary embodiment shown in FIG. 1, is composed of five metal plates. One delimiting side of the sandwich ink-jet head is formed by a membrane plate 15 made of nickel with a plate thickness of 0.03 mm, on which, in accordance with the number of nozzles (in this case 24), piezoelectric platelets 14 with a diameter of approximately 1 mm are arranged as drive elements for the pressure chambers.

Adjoining the membrane plate is a pressure chamber plate 16, which is likewise made of nickel and which has a thickness of 0.2 mm in accordance with the desired height of the pressure chambers. All pressure chambers 17 of the sandwich head, as well as feed structures 18 for the ink supply are located in the pressure chamber plate 16. In turn, adjoining the pressure chamber plate 16, is a cover plate 19 of a thickness of approximately 0.1 mm, which contains the emerging regions of the nozzle duct 20 and of the ink supply duct 21 of each pressure chamber 17, and furthermore openings 22 which are part of the ink supply.

In the following throttle plate 23 with a thickness of 0.1 mm, throttle sections 24 with slot-shaped cross-section are arranged in the form of slits and openings 25 as parts of the ink supply. The sandwich ink-jet head is completed by a nozzle plate 26 (thickness 0.1 mm), which is likewise made of nickel and on which the nozzle orifices 27 are arranged in a configuration according to the desired resolution. This produces the ink flow in the head marked by an arrow 51, to be precise starting from the ink supply orifice 44 through to the nozzle plate 26.

After production of the individual metal plates by etching, stamping or by means of electroplating, the metal plates are placed in layers above one another and joined by means of diffusion welding. For this purpose, the plates are pressed together and subjected thus under protective gas or a vacuum to an elevated temperature. Temperature and holding time are dependent here on the respective material of the nozzle plates.

In the production of ink-jet print heads, diffusion welding is advantageous because a flat metallic joint is produced and the duct structure is not altered by excess solder or adhesive. Moreover, it produces a heat-resistant construction and uniform metal can be used for the head. In order to permit simple production of the structures, it is advantageous to produce the plates from a material which is readily etched, such as nickel silver, but for achieving a good weld joint, however, to silver-plate them, and to weld these silver-plated parts in a compound with nickel parts.

Diffusion welding is possible at temperatures between 40 and 90% of the absolute melting temperature of the part material. In order to achieve a material pairing with silver which is favourable for diffusion welding, it is sufficient when building up layers inter alia, to silver plate each least each second plate.

After the production of this head, hereinafter termed sandwich ink-jet head, which can be carried out completely automatically, the piezoelectric platelets 14 are then, if this has not already taken place previously, bonded to the membrane plate 15.

In the exemplary embodiment illustrated in FIGS. 2 to 5, the sandwich ink-jet head has a resistor array 30 on the membrane plate 15. Said resistor array 30 consists of a large number of integrated individual resistors 31, which when built in are connected in series to the piezoelectric platelets 14 and serve as balancing resistors for the piezoelectric platelets 14.

In addition there is located on the membrane plate a heating element 32 which serves to maintain the sandwich ink-jet head, and hence the ink in the sandwich ink-jet head, at a defined even temperature. The resistor array 30 and the heating element 32 can either be designed and arranged on the metal plate by means of electroplating, or they are produced separately and bonded to the metal plate, or joined to the metal plate by means of diffusion welding. In any case, the resistor array is designed and made of a material of this kind in such a way that it can be balanced by means of a laser beam, that is the value of the individual resistors 31 can be changed. As a rule this is effected by a laser beam cutting into the individual resistors 31 and as a result changing the cross-section of the material and hence the resistance.

The sandwich ink-jet head automatically produced in this way, including resistor array 30 and possibly heating element 32, is now cast into a so-called dual in-line package, illustrated in FIGS. 2 to 5. Dual in-line packages denote plug-in packages which are constructed in accordance with DIN 41866 and are made of plastic. They contain a number of connecting leads 33 which are arranged between a top side and a bottom of the plug-in package sprayed from plastic. In this design, the connecting leads 33 are arranged in two rows and their connecting lugs lie opposite one another in the casing. It is also possible to arrange the connecting leads on one side, so that the ink head can be plugged in laterally or downwards. On its top side, the plug-in package has a receiving opening 35 for receiving the sandwich ink-jet head, and on its underside a contacting and balancing opening 36 which can be closed by means of a cover 37.

Designed at the edges of the top side of the plug-in package are strips 38 which laterally project beyond the actual body of the plug-in package and which prevent excess ink emerging out of the sandwich ink-jet head via the nozzles from dirtying the connecting leads 33. The top part 39 of the plug-in package itself has on its underside a triangular drip gutter 40 which projects beyond the body 34 of the plug-in package and which feeds the excess ink 41 to a receptacle (not shown here).

The entire ink-jet print head is produced in such a manner that the prefabricated sandwich ink-jet head is inserted into the receiving opening 35 and there welded, using ultrasound for example.

It is however also possible to spray the sandwich ink-jet head directly into the plug-in package.

In the configuration illustrated in FIG. 5, the resistor array 30 and the heating elements 32, or the piezoelectric platelets 15, are accessible via the contacting and balancing opening 36.

To make the contact, the sandwich ink-jet head mounted in the plug-in package is fed to a fully automatic bonding device, which in a known manner joins the connections of the sandwich ink-jet head, including heating elements and resistor array 30, to the corresponding connections of the connecting leads 33 with corresponding bonding wires 42.

Following this, the ink-jet print head is inserted into an automatic balancing machine (not shown here) which fills the ink-jet print head with ink and balances the individual resistors 31 using a laser in such a manner that a uniform travelling speed of the ejected ink droplets is set.

Subsequently, the contacting and balancing opening 36 is sealed so as to be tight with respect to ink, to be precise by welding on (ultrasound) the cover 37.

The ink-jet print head thus produced can now be clipped into or soldered to a mounting 43 arranged on the carriage of the ink-jet printing device in the form of, for example, a socket or a circuit board with corresponding openings, in a single way corresponding to the illustration of FIG. 2. At the same time this joins the ink-jetprint head to the ink supply system of the ink-jet printing device via the ink inlet orifice 44. For this purpose, there is arranged on the printer carriage a resilient ink adaptor 45 which consists of a mouthpiece 47 that is movable in a mounting part 46, and that comes to lie as a result of the action of the spring 48 via seals 49 against the ink inlet orifice 44, and seals off the latter so that ink can be supplied via the ink duct 50 without leakage to the ink-jet print head.

In the vertical configuration of the ink-jet print head illustrated, the drip gutter 40 conducts the excess ink emerging from the sandwich ink-jet head away to a receptacle which is not shown here.

I claim:

1. An ink-jet print head for an ink-jet printing device, comprising a sandwich ink-jet head having individual superjacently arranged plates (14, 16, 19, 23, 26) which accommodate ink ducts, drive elements, pressure chambers and the like and which are rigidly connected to one another;

an ink inlet opening (44) for supplying the printing fluid (41);

a plug-in package accommodating said sandwich ink-jet head and having connecting leads (33), said plug-in package having on its top side a receiving opening (35) for said sandwich ink-jet head and a further contacting and balancing opening (36) arranged on the top side or underside of said plug-in package being formed to be tightly sealed with respect to ink;

electric balancing elements (31) assigned to each of said drive elements of said sandwich ink-jet head, all balancing elements (21) being arranged on a balancing plate (30) which is arranged in the plug-in package and which is designed to be balanced via said contacting and balancing opening (36), and said balancing elements being in the form of resistors (31) suitable being balanced using a laser.

2. An ink-jet print head according to claim 1, wherein heating elements (32) are provided for said sandwich ink-jet head.

3. An ink-jet print head according to claim 2, wherein said balancing plate (30) and/or said heating elements (32) are assigned to said sandwich ink-jet head.

4. An ink-jet print head according to claim 1, wherein strips (38) projecting laterally beyond said plug-in package and covering the connecting leads (33) are provided.

5. An ink-jet print head according to claim 1, wherein a drip gutter (40) for carrying away excess ink is arranged on the top side of said plug-in package.

6. An ink-jet print head according to claim 1, wherein the ink supply system of said ink-jet printer has a detachable adaptor connection (45) interacting with said ink inlet opening (44).

7. An ink-jet print head according to claim 1, wherein said ink-jet print head is arranged so as to be exchangeable in a mounting (43) of said ink-jet printing device.

* * * * *